US009333533B2

(12) United States Patent
Dudley et al.

(10) Patent No.: US 9,333,533 B2
(45) Date of Patent: May 10, 2016

(54) USE OF A TRANSPORT COATING TO APPLY A THIN COATED LAYER

(75) Inventors: William R. Dudley, Geneseo, NY (US); William Blake Kolb, West Lakeland, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 220 days.

(21) Appl. No.: 13/877,342

(22) PCT Filed: Nov. 21, 2011

(86) PCT No.: PCT/US2011/061598

§ 371 (c)(1), (2), (4) Date: Apr. 2, 2013

(87) PCT Pub. No.: WO2012/071303

PCT Pub. Date: May 31, 2012

(65) Prior Publication Data

US 2013/0230653 A1 Sep. 5, 2013

Related U.S. Application Data

(60) Provisional application No. 61/416,887, filed on Nov. 24, 2010.

(51) Int. Cl.

| | |
|---|---|
| ***B05D 7/00*** | (2006.01) |
| ***B05D 1/26*** | (2006.01) |
| ***B05D 1/40*** | (2006.01) |

(52) U.S. Cl.

CPC .. *B05D 7/52* (2013.01); *B05D 1/26* (2013.01); *B05D 1/40* (2013.01); *B05D 7/54* (2013.01); *B05D 2252/02* (2013.01)

(58) Field of Classification Search

None

See application file for complete search history.

(56) References Cited

U.S. PATENT DOCUMENTS

| | | | | |
|---|---|---|---|---|
| 4,693,935 | A | 9/1987 | Mazurek | |
| 5,527,578 | A | 6/1996 | Mazurek | |
| 5,858,545 | A | 1/1999 | Everaerts | |
| 5,962,075 | A * | 10/1999 | Sartor et al. | 427/356 |
| 6,007,914 | A | 12/1999 | Joseph | |
| 6,123,890 | A | 9/2000 | Mazurek | |
| 6,197,397 | B1 | 3/2001 | Sher | |

(Continued)

FOREIGN PATENT DOCUMENTS

| | | |
|---|---|---|
| BE | 678593 | 9/1966 |
| CA | 2187881 | 11/1995 |

(Continued)

OTHER PUBLICATIONS

Cohen, Modern Coating and Drying Technology, VCH Publishers, Inc., pp. 122-126, (1992).

(Continued)

*Primary Examiner* — Lisha Jiang
(74) *Attorney, Agent, or Firm* — Qiang Han

(57) ABSTRACT

It has now been determined that a first coating layer may be applied to a substrate by a first coating die in a much thinner layer than its rheological properties and/or surface properties would normally allow. This is accomplished by using a second coating fluid dispensed from a second coating die acting as a "dynamic liquid squeegee" to transport, spread, even, or meter the first coating layer on the substrate by varying a gap between the second coating die and the substrate.

18 Claims, 2 Drawing Sheets

(56) References Cited

U.S. PATENT DOCUMENTS

| | | | | |
|---|---|---|---|---|
| 6,627,262 | B1 | 9/2003 | Soas | |
| 6,838,142 | B2 | 1/2005 | Yang | |
| 6,838,150 | B2 | 1/2005 | Mazurek | |
| 2003/0087038 | A1 * | 5/2003 | Su et al. | 427/420 |
| 2008/0220196 | A1 * | 9/2008 | Ukei et al. | 428/41.8 |
| 2009/0110861 | A1 | 4/2009 | Sherman | |

FOREIGN PATENT DOCUMENTS

| | | | | |
|---|---|---|---|---|
| JP | 09-511681 | | 11/1997 | |
| JP | 2000-140738 | | 5/2000 | |
| JP | 2000140738 | A * | 5/2000 | B05C 5/02 |
| JP | 2002-532232 | | 10/2002 | |
| WO | 00-02966 | | 1/2000 | |
| WO | WO 01/70418 | | 9/2001 | |
| WO | 2009-058466 | | 5/2009 | |

OTHER PUBLICATIONS

Tricot, "Surfactants: Static and Dynamic Surface Tension", Liquid Film Coating, Chapman and Hall, First Ed, pp. 99-136, (1997).

International Search Report for PCT/US2011/061598, mailed on Jun. 27, 2012, 5 pages.

Supplementary European Search Report, EP Application No. 11843864, dated Mar. 21, 2014, 3 pages.

* cited by examiner

USE OF A TRANSPORT COATING TO APPLY A THIN COATED LAYER

BACKGROUND

Today, there is demand for high performance coated articles manufactured by coating two or more layers of fluid onto a continuous web. The fluids can be coated using a single layer coating process such that the fluids are coated in series with each layer being dried, cured, etc. before the next one is applied. For reasons such as efficiency and cost, it is usually more desirable to employ multilayer coating processes in which the fluids are coated simultaneously or nearly simultaneously onto the web.

Applicators used in multilayer coating processes can be designed to deliver a wide range of fluids, but this is typically not the case if the fluids are to be coated simultaneously. That is, for a given set of fluids to be coated simultaneously, the particular applicator and process conditions used in a multilayer coating process often dictate how different the fluids can be with respect to a particular property such as surface tension, viscosity, etc. The interaction between the substrate and the layer deposited closest to that substrate is also a consideration. Thus, there is a need for multilayer coating processes that are amenable to coating simultaneously fluids having properties that are very different from each other. There is also a need for multilayer coating processes that extends the types of materials that can be used with difficult to coat substrates.

SUMMARY

It has now been determined that a coating may be applied to a substrate in a much thinner layer than its rheological properties and/or surface properties would normally allow. This is accomplished by using a transport layer dispensed from one coating die slot to act as a "dynamic squeegee" to spread and even another coating layer dispensed from a different coating die slot onto a substrate. Manipulation of the rheological properties of the transport layer and also manipulation of the physical positioning of the coating die slot that dispenses the transport layer can both be used as process parameters to accomplish the amount of spreading of the underlying coating layer that suits a particular purpose.

Hence, in one embodiment, the invention resides in a method of coating a substrate including the steps of: providing a first coating die having a first slot width; providing a second coating die having a second slot width; applying a first coating fluid from the first coating die onto a substrate forming a first coating layer; applying a viscoelastic second coating fluid from the second coating die over the first coating layer on the substrate forming a second coating layer; and varying a gap between the second coating die and the substrate to increase the width and reduce the thickness of the first coating layer on the substrate.

BRIEF DESCRIPTION OF THE DRAWINGS

It is to be understood by one of ordinary skill in the art that the present discussion is a description of exemplary embodiments only, and is not intended as limiting the broader aspects of the present disclosure, which broader aspects are embodied in the exemplary construction.

Figure 1:
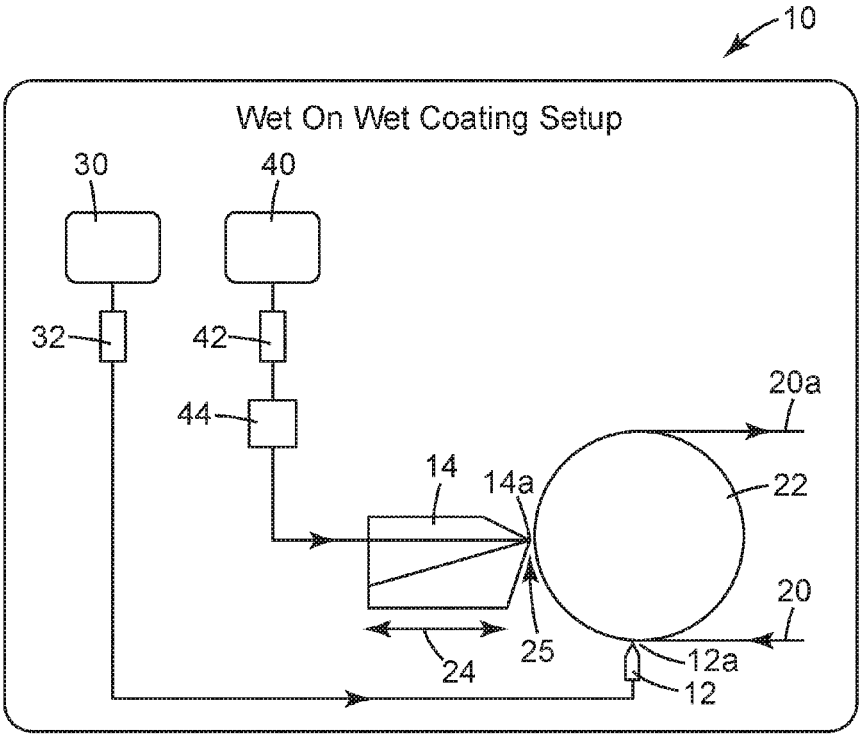
FIG. 1 illustrates a schematic view of a coating apparatus suited for performing the method of the present invention.

Repeated use of reference characters in the specification and drawings is intended to represent the same or analogous features or elements of the disclosure.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "viscoelastic" means exhibiting both viscous and elastic characteristics when undergoing deformation.

DETAILED DESCRIPTION

Surface tension and surface energy are two important properties in coating operations. For a single layer of fluid being coated onto a substrate, proper wetting of the fluid on the substrate occurs if the surface tension of the fluid is lower than the surface energy of the substrate. If this is not the case, then forces exerted along the surface of the fluid would likely cause it to "bead up" and form into drops. Likewise, in a typical multilayer coating operation in which two different fluids are simultaneously or sequentially coated onto a substrate, it is generally accepted that the fluid used to form the upper layer must have a lower surface tension as compared to that of the fluid first applied to the substrate. Otherwise, the fluid used to form the upper layer would not be able to wet the layer formed underneath it. Further discussion of the relationships for surface tension and surface energy with respect to multilayer coating operations can be found in Cohen, E. and Gutoff, E. *Modern Coating and Drying Technology*; VCH Publishers: New York, 1992; p. 122; and in Tricot Y-M. *Surfactants: Static and Dynamic Surface Tension* in Liquid Film Coating; Kistler, S. F. and Schweizer, P. M., Eds.; Chapman & Hall: London, 1997; p. 99.

Surprisingly, despite the teachings described above, by coating the substrate first with a wetting layer and thereafter with an extensional layer which often aids in the carrying and delivery of the wetting material to the substrate and thus referred to as a "transport layer," and using the transport layer as a "liquid squeegee" to level and uniformly spread the wetting layer against the substrate, the manufacturer is offered a wider selection of both coating and substrate materials and processing conditions such as flow rates line speeds and/or curing conditions.

Among other applications, the present invention has utility in the manufacture of large-scale adhesive graphics for the side panels of semi-truck trailers or vehicles. In these applications, structured liners and having a pattern that shapes air relief channels into the adhesive, allow the adhesive graphics to be applied without large air pockets becoming trapped between the attachment surface and the adhesive graphic. However this requires a delicate process that balances the ability of the adhesive to release from the structured liner at the point of use, the ability to coat the structured liner during manufacture, and the cohesion of the adhesive to the backing material attached to the second coating layer. With the techniques of the present invention, and with the substrate being a structured liner, the wetting layer can be selected for repositionability, for forming a very thin conformal layer adjacent to the structured liner, and for efficiently wetting the structured liner to minimize trapping tiny air bubbles between the wetting layer and the structured liner.

Referring now to FIG. 1, a schematic view of a coating apparatus 10 is illustrated for performing the method of the present invention. The coating apparatus 10 includes a first coating die 12 having a first slot 12*a* which has a first slot width, and a second coating die 14 having a second slot 14*a* which has a second slot width. In some embodiments, the second slot width 14*a* is greater than the first slot width 12*a*. The second slot width can be significantly greater than the first slot width, and in one embodiment, the second slot width was 2.0 times greater in width the first slot width. The second slot width can be equal to or greater than the first slot width since the final coating width and resultant dry thickness of the wetting layer is determined by the amount of pressure and available material delivered to the rolling bank of coating material acting as a squeegee. The first slot width 12*a* is typically chosen so that a reasonable gap between the second coating die and the substrate are possible for the rheology at hand. A first shim with multiple openings might be used in the case where the desired end result would be a continuous transport layer over stripes of a wetting layer.

A substrate 20 is conveyed and positioned by a back-up roll 22. The second coating die 14 is provided with a support mechanism 24 that enables changing or varying a gap 25 between the slot 14*a* of the second coating die 14 and the substrate 20. Various support mechanisms are known to those of skill in the mechanical engineering arts and they can be as simple as a series of drilled holes to vary the bolted position of the second coating die, intermediate such as a threaded rod and hand crank with sliding supports, or complex such a computer controlled linear servo drive. As will be discussed with more particularity below, varying the gap 25 serves to change the width of a first coating layer 27 (FIG. 2) dispensed by the first coating die 12 on the substrate 20.

Material to be dispensed by the first coating die 12 is stored in first holding vessel 30. In many embodiments, material from the first holding vessel 30 will be pressurized by first pump 32. Similarly, material to be dispensed by the second coating die 14 is stored in second holding vessel 40. In many embodiments, material from the second holding vessel 40 will be pressurized by second pump 42 and metered by flow meter 44. Coated web 20*a* separates from the back-up roll 22 after the second coating die 14.

In some embodiments, the first and the second coating dies may be enclosed in a single die body. Such an arrangement is illustrated in copending and coassigned U.S. Application 2009/0110861A1, "Pressure Sensitive Adhesive Article," (Sherman), which is hereby incorporated by reference.

Figure 3:
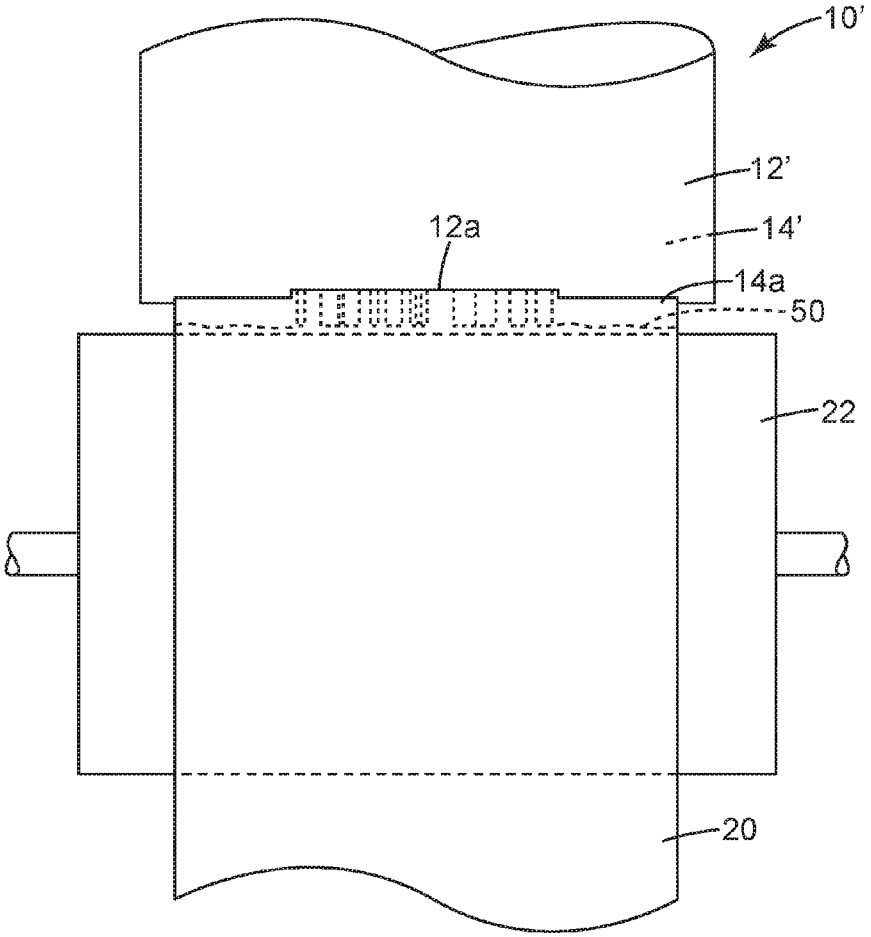
FIG. 3 is a top view of an alternate coating apparatus for performing the method of the present invention.

Referring now to FIG. 3, a top view of an alternate coating apparatus 10' is illustrated. Coating apparatus 10' has the first and second dies 12' and 14' enclosed in a single die body. In this view, it is shown that in connection with the present invention, the first coating fluid being dispensed by the first slot 12*a* does not have to spread uniformly or completely wet the second coating fluid being dispensed by the second slot 14*a*. The outflow from the first die slot 12*a* may be broken up and patchy; the discontinuities are smoothed and erased within a rolling bank 50 of the second coating fluid as it transports the first coating fluid to the substrate 20. The streaks or patches of the first coating fluid can be in the machine direction, in the cross machine direction, or both directions.

Figure 4:
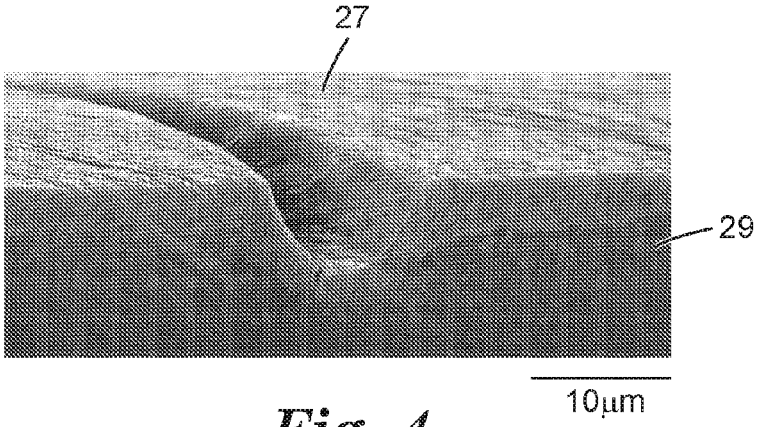
FIG. 4 is a photomicrograph of an adhesive coating laminated to a substrate made according to the method of the present invention after its microreplicated liner has been peeled away.

The material dispensed by the first coating die, which may be called the "wetting layer", will, in many embodiments, comprise pressure sensitive adhesive and optional additional components depending on the desired properties of the first coating layer. The properties of the first coating layer may be designed so that it releases easily from the substrate, facilitating separation of the first coating layer from the substrate with little or no damage to the second coating layer 29 (FIG. 4). The properties of the first coating layer may also be designed so that an article (e.g. adhesive graphic) with a backing adhered to the second coating layer is temporarily repositionable. In practice, it is extremely difficult to achieve precise positioning of an adhesive article on an object once the two are in contact. Bubbles, wrinkles, etc. are commonplace when the two are adhered. Attempts to correct any of these problems often results in damage to the article or at least to the adhesive layer. Preferably, the first coating layer is designed to impart temporary repositionability to the article with little or no change in bulk adhesive properties of the second coating layer. This may be evidenced by low initial peel adhesion (bond strength) of the article to the object, followed by increasing peel adhesion over time. For example, it may be useful for an article to exhibit an initial peel adhesion that is lower by about 20% or more relative to an article without the first coating layer. The first coating layer can also be designed to keep the second coating layer from sticking to itself once the substrate is removed.

In general, pressure sensitive adhesives possess properties including the following: (1) permanent tack, (2) adherence to a surface with no more than finger pressure, (3) sufficient ability to hold onto a surface, and (4) sufficient cohesive strength to be cleanly removed from the surface. Materials that have been found to function well as pressure sensitive adhesives are polymers designed and formulated to exhibit the requisite viscoelastic properties resulting in a desired balance of tack, peel adhesion, and shear holding power. Obtaining the proper balance of properties is not a simple process.

Some of the pressure sensitive adhesives suitable for use as a wetting layer may comprise a polymeric and/or oligomeric adhesive prepared by polymerizing one or more monomers. In one example, the first coating layer may comprise a first pressure sensitive adhesive that comprises silicone. Examples of silicones include those described in U.S. Pat. No. 5,527,578; U.S. Pat. No. 5,858,545; and WO 00/02966. Specific examples include polydiorganosiloxane polyurea copolymers and blends thereof, such as those described in U.S. Pat. No. 6,007,914 and polysiloxane-polyalkylene block copolymers. Other examples of silicones include silanols, silicone hydrides, siloxanes, epoxides, and (meth)acrylates. The first pressure sensitive adhesive may also comprise a fluorochemical.

Additional examples of a pressure sensitive adhesive suitable for use as a first coating layer acting as a wetting layer that comprise a silicone-containing pressure sensitive adhesive include copolymers comprising a vinyl polymeric backbone having polysiloxane moieties grafted thereto as described in U.S. Pat. No. 4,693,935. The copolymer may comprise: an A monomer comprising at least one free radically polymerizable monomer; a C monomer having the formula: XYnSiR3-mZm wherein: X is a vinyl group polymerizable with the A monomer, Y is a divalent linking group, R is a hydrogen or a lower alkyl, aryl, or alkoxy group, Z is a monovalent siloxane moiety having a MWn of at least about 500 and is essentially unreactive under copolymerization conditions and is pendant from the vinyl polymeric backbone, n=0 or 1, and m=1, 2, or 3. The copolymer may optionally comprise a B monomer.

The A monomer may comprise at least one free radically polymerizable monomer and may be selected such that a tacky or tackifiable material is obtained upon polymerization of the A monomer, or the A monomer and the B monomer if the latter is used. Examples of A monomers include (meth) acrylic acid esters of non-tertiary alcohols such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, cyclohexanol, 2-ethyl-1-butanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-dodecanol, 1-hexadecanol, 1-octadecanol, and the like, the alcohols having from 1 to 18 carbon atoms with the average number of carbon atoms being from 4 to 12, as well as styrene, vinyl esters, vinyl chloride, vinylidene chloride, and the like. Examples of A monomers also include iso-octyl (meth)acrylate, iso-nonyl(meth)acrylate, isodecyl(meth) acrylate, 2-ethylhexyl(meth)acrylate, and ethyl(meth)acrylate. Combinations of any of the A monomers described herein may also be used.

The B monomer may be referred to as a reinforcing monomer and generally includes polar monomers and macromonomers having a Tg or Tm above about 20° C. Examples of polar monomers include (meth)acrylic acid, itaconic acid, (meth) acrylamide, N,N-dimethyl(meth)acrylamide, (meth)acrylonitrile, and N-vinyl pyrrolidone, and examples of macromonomers include poly(styrene), poly(a-methylstyrene), poly(vinyl toluene), and poly(methylmethacrylate).

The C monomer is polymerizable with the A and B monomers and generally has silicone functionality incorporated into its structure. The X group may have the formula:

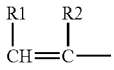

wherein: R1 is hydrogen or a COOH group; R2 is hydrogen, a methyl group, or a —$CH_2$COOH group. The Y group may be any divalent group capable of linking the X group to a silicone atom, for example, the Y group may have any one of the formulas:

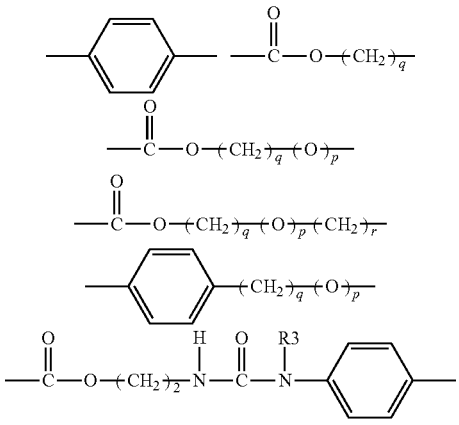

-continued

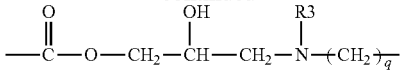

wherein: R4 and R6 are independently lower alkyl, aryl, or fluoralkyl, where lower alkyl and fluoralkyl both refer to alkyl groups having from 1 to 3 carbon atoms and where aryl refers to phenyl or substituted phenyl; R5 may be alkyl, alkoxy, alkylamino, aryl, hydroxyl, or fluoroalkyl; and s is an integer of from about 5 to about 700. Particular examples of C monomers include silicone macromonomers described in U.S. Pat. No. 4,693,935.

The molecular weight and amount of the C monomer should be great enough so that the desired repositionability is obtained, but low enough so that it is compatible during polymerization with the A and optional B monomers. In general, the molecular weight of the C monomer is between about 500 and about 50,000, for example, between about 5000 to about 25,000.

The relative amounts of the A, B and C monomers needed for preparing the silicon-containing pressure sensitive adhesive will depend on the desired properties for the first coating layer as described above. Accordingly, relative to the total weight of the monomers, the A monomer may range from about 30 wt. % to about 99.99 wt. %, the C monomer from about 0.01 wt. % to about 50 wt. %, and the B and C monomers together from about 0.01 wt. % to about 70 wt. %. Typically, the amount of C monomer will have the most direct effect on lowering the initial peel adhesion and the amount used will depend, at least in part, on its molecular weight.

The amount of the B monomer typically does not exceed about 20 wt. % based on the total weight of all monomers such that excessive firmness of the silicon-containing pressure sensitive adhesive is avoided. For example, if from about 2 to about 15 wt. % of the B monomer is used, the silicon-containing pressure sensitive adhesive is likely to have high cohesive and internal strength while maintaining good adhesive properties.

In a particular example, the first pressure sensitive adhesive comprises a copolymer prepared from polymerizing iso-octyl acrylate, acrylamide, and silicon-containing monomer in a weight ratio of about 91:4:5, respectively.

The A monomer, optional B monomer, and C monomer may be polymerized by conventional free radical polymerization methods as described in U.S. Pat. No. 4,693,935, for example, by solution, suspension, emulsion, or bulk polymerization. For solution polymerization, the monomers are dissolved in an inert organic solvent and polymerized using a suitable free radical initiator which may be thermally or photochemically activated. Polymer grafting techniques are also described in U.S. Pat. No. 4,693,935, each providing a degree of predictability of the properties of the end product. For example, the vinyl polymeric backbone may be formed and then polymerized with a cyclic siloxane monomer. In another example, the vinyl polymeric backbone may be formed and then polymerized with a monofunctional siloxane polymer.

A variety of additional components may be included in the wetting or first coating fluid. For example, tackifying resins and plasticizers may be used in order to adjust the tack properties of the first coating layer. Tackifying resins include rosins and resins of polyterpenes, phenolics, and coumarone-indenes and typically are used in an amount of up to about 150 parts by weight, based on 100 parts by weight of the silicon-containing pressure sensitive adhesive.

Plasticizers include aromatic, paraffinic, and naphthenic extender oils, and are typically used in an amount of up to about 50 parts by weight, based on 100 parts by weight of the silicon-containing pressure sensitive adhesive. Pigments, fillers, glass beads, stabilizers, cross-linkers, etc. may also be added.

As described above, the surface tension of the first coating fluid may be less than that of the second coating fluid. A lower surface tension may be achieved by the presence of the first pressure sensitive adhesive, i.e., without any additional components necessary for lowering the surface tension. For example, if the first pressure sensitive adhesive comprises silicone or is a silicon-containing pressure sensitive adhesive and the second pressure sensitive adhesive is not either of these, then the first coating fluid will likely have a lower surface tension than the second coating fluid. It is also possible that additional components such as surfactants may be used to lower the surface tension. It is also possible to employ solvents that give the first coating fluid a lower surface tension than the second coating fluid. The difference in surface tensions between the first and second fluids is not particularly limited as long as the desired degree of wetting occurs.

As described above with a dual slot dual feed coating die, the first coating fluid is flowed onto the continuous flowing layer formed by the second coating fluid. This first coating fluid forms a first coating layer. In general, the first coating layer should be thick enough to impart the desired properties to the resulting article, for example, to form a continuous first coating layer, if desirable. The first coating layer should also be thin enough so that the properties of the second coating layer or film are not adversely affected. The thickness of the first coating layer is typically less than about 25 um. If the first coating fluid comprises solvent, then the thickness of the first coating layer may be less than the coated thickness, if solvent migrates from the first coating layer and into the second coating layer and/or into the substrate. The dry thickness of the cured first coating layer may also be less than 25 μm, 10 μm, less than 5 μm, less than 0.5 μm, less than 0.20 μm, or less than 0.15 μm, or less than 0.10 μm and greater than 0 μm.

As with other multilayer coating techniques, for best results, a stable interface is required to maintain discrete layers during and after processing. First coating layers or "wetting layers" preferred for transport coating are, most often, low viscosity and low surface tension. Other parameters such as pH, and density are chosen so that mixing of the coating layers are avoided. The properties of the structured substrate will, to some degree, dictate an acceptable rheology that results in uniform conformal coatings on a structured substrate.

The material dispensed by the second coating die, which may be called the "transport layer" because it can aid in allowing the "wetting layer" to bridge the gap from the first coating die to the substrate being coated, should have some viscoelastic nature. Without intending to be bound by any theory, the inventors believe that the viscoelasticity of the transport layer exerts a temporary shear stress to the wetting layer. While the second coating fluid is viscoelastic it is not required to be tacky like an adhesive. As a result, it has been observed that the first coating fluid may have a wider range of properties, and may even be substantially Newtonian in flow character.

In many convenient embodiments, the second coating fluid will comprise a viscoelastic pressure sensitive adhesive and optional additional components depending on the desired properties of the coating formed. Forming a coating layer or film from the second coating fluid may comprise evaporation of solvent from the second coating fluid after it is coated, or it may comprise cooling if the second coating fluid comprises a hot melt pressure sensitive adhesive. Forming a film from the second coating fluid may also comprise curing components in the fluid, such as by applying thermal, UV or other source of radiant energy to initiate a reaction between a crosslinking agent and a polymer or oligomer component. A combination of any of these may also be used.

The properties of the film, or second coating layer, may be designed so that it builds to a predetermined minimum peel adhesion with a particular kind of object. For example, an application may require that the second coating layer not be removable from an object after a period of time or only removable under severe conditions such as high heat or solvent that dissolves the layer. Such an article may comprise a paint replacement film for automobiles. Alternatively, an application may require that the film be removable after a short period of time such as for a paint masking tape on a window, or after a longer period of time such as for a protective film on a display device.

Useful second pressure sensitive adhesives include materials having the properties described above for the first pressure sensitive adhesive. Examples include copolymers comprising from about 30 wt. % to about 99.99 wt. % A monomer and from about 0.01 wt. % to about 70 wt. % B monomer. For example, the second pressure sensitive adhesive may comprise from about 90 to about 99.99 wt. % of iso-octyl acrylate, 2-ethylhexyl acrylate, n-butyl acrylate, 2-methylbutyl acrylate, or a combination thereof, and from about 0.01 to about 10 wt. % (meth)acrylamide or (meth)acrylic acid. The second pressure sensitive adhesive may also be crosslinkable. A variety of additional components may be included in the second coating fluid as described above for the first coating fluid providing it remains visco-elastic and forms a continuous film or platform for the first coating fluid "wetting material" to contact at acceptable die gaps.

In an embodiment of the invention, the viscoelastic second coating fluid will have a higher viscosity than the first coating fluid when each is tested at the same shear rate. In other embodiments of the invention, the viscoelastic second coating fluid will be shear thinning decreasing in viscosity as the shear rate increases and also having a higher viscosity when each fluid is tested at the same shear rate; however, the viscosity of the viscoelastic second coating is preferably greater than the viscosity of the first coating fluid even when undergoing shear thinning. In one embodiment as used in the Examples, the second coating fluid had a viscosity of about 15.7 Pascal·seconds at a shear rate of 13.6 seconds$^{-1}$ and a viscosity of about 1.6 Pascal·seconds at a shear rate of 498.5 seconds$^{-1}$ when tested with a Bohlin V88 Viscometer setup with the cone and plate option for high viscosity fluids that is capable of rotational speed: 0-1000 rpm; shear rate range: 0-2×104 s-1; torque range 0-10 m nm; shear stress range: 0 Pa-104 Pa; viscosity range: 5 mPa·s-107 mPa·s; and temperature range: −35° c.-150° c.

It is believed that during application of the second coating fluid internal or extensional forces are developed when it resists shear flow and strain occurring as it travels from the second coater's slot orifice to the substrate where after a short time stress is removed and the second coating travels with the substrate in a relaxed state. This internal force or vector components thereof can result in spreading, leveling or metering of the first coating fluid when the proper materials and conditions are in place. These extensional forces allow for not only metering the first coating fluid thinner than it can be coated individually, but also they are beneficial in overcoming surface tension/surface energy imbalances between the first coating fluid and the substrate being coated such as may be found in a release surface being coated. In some cases improved filling of structured substrates due to low surface tension, low viscosity first coating fluid results in the improved replication of structures or improved drying at higher production rates with reduced loads because little or no air is trapped between web and fluids.

The substrate 20 may comprise any suitable carrier web and may be flexible. Examples include paper such as clay-coated paper or polyethylene-coated paper. Examples also include polymeric films comprising one or more polymers such as cellulose acetate butyrate; cellulose acetate propionate; cellulose triacetate; poly(meth)acrylates such as polymethyl methacrylate; polyesters such as polyethylene terephthalate, polyethylene naphthalate, and copolymers or blends based on naphthalene dicarboxylic acids; polyether sulfones; polyurethanes; polycarbonates; polyvinyl chloride; syndiotactic polystyrene; cyclic olefin copolymers; and polyolefins including polyethylene and polypropylene such as cast and biaxially oriented polypropylene. The substrate may comprise single or multiple layers, such as polyethylene-coated polyethylene terephthalate. The substrate may be primed or treated to impart some desired property to one or more of its surfaces. Examples of such treatments include corona, flame, plasma and chemical treatments.

The substrate may comprise a release liner which may be any release liner known to those of skill in the art and that is capable of being placed in intimate contact with the first and/or second coating layers and subsequently removed without affecting performance of the layers. The release liner can be any of the aforementioned papers or polymeric films, either of which can be coated with a release coating.

The surface of the substrate onto which the composite flowing layer is coated may be substantially flat, or it may have a textured or structured surface. When substrates having textured or structured surfaces are used, they are typically release liners. The textured or structured surface imparts a shape to the first and/or second coating layers. One useful shape can be two or more planar surfaces separated by at least one groove or channel as shown in FIG. 4. Textured surfaces include those having random roughness, random patterns of shapes, ordered roughness, ordered patterns of shapes, or combinations thereof. Structured surfaces include microstructured surfaces such as those provided by microstructured release liners. Microstructured surfaces generally comprise a microstructure having at least two lateral dimensions (i.e. dimensions in the plane of the film) less than 1.4 mm (55 mils), made as described, for example, in U.S. Pat. No. 6,197,397; U.S. Pat. No. 6,123,890; U.S. Pat. No. 6,838,142 B2; and U.S. Pat. No. 6,838,150 B2. The microstructured surface may comprise, for example, a series of shapes including ridges, posts, pyramids, hemispheres and cones, and/or they may be protrusions or depressions having flat, pointed, truncated, or rounded parts, any of which may have angled or perpendicular sides relative to the plane of the surface. The microstructured surface may have a pattern such as linear channels or intersecting channels forming a grid, be random, or a combination thereof. The microstructured surface may impart substantially continuous open pathways or grooves into the first and/or second coating layers.

As described above, the method disclosed herein can be used to prepare articles such as multilayer coated articles comprising a substrate having a first coating layer on a first major surface of the substrate, the first coating layer comprising a first pressure sensitive adhesive and having a dry thickness of less than 25 μm, a second coating layer disposed over the first coating layer, the second coating layer comprising a second pressure sensitive adhesive.

After the layers are sufficiently dried, cured, etc., a backing may be applied to the second coating layer opposite the first coating layer. The backing may comprise paper or a polymeric film such as polyvinyl chloride. In many embodiments, the backing and second coating layer will have a much higher peel adhesion between each other than the first coating layer has to the substrate. Contacting a backing to the second coating layer may comprise laminating the backing to the second coating layer. When the substrate is removed, the resulting adhesive article comprises: a backing; a second coating layer on a first major surface of the backing, the second coating layer comprising a second pressure sensitive adhesive; and a first coating layer on the second coating layer opposite the backing, the first coating layer comprising a first pressure sensitive adhesive and having, in some embodiments, a thickness of less than 25 μm.

The adhesive article may be used in a variety of applications. For example, it may be a tape or a label. The backing may be imaged using a variety of commercial techniques such that the adhesive article may be used as a graphic art film such as a sign. The exposed surface of the backing (opposite the second coating layer) may be hard enough so that the adhesive article can be used for protecting an object such as an automobile part or an optical display. One or more of the backing, second coating layer, or first coating layer may be opaque and/or colored so that the adhesive article can be used as a paint replacement film or a window film to provide decoration and/or privacy. In addition, one or more of the backing, second coating layer, or first coating layer may comprise absorbing and/or reflecting components so that the adhesive article can be used as a window film that reflects light and or heat.

In various embodiments of the invention, substrate could be a microstructured reflective material and the wetting layer could be a low index solution to provide a thinner more durable reflector. The present invention is not limited to applying only two coating layers to the substrate. Additional layers could be applied over the top of the transport layer (second coating layer) that is applied over the wetting layer (first coating layer). Coating materials could be floated on top of the transport layer to result in more than 2 layers on the substrate. Furthermore, the invention is suitable for at least partially overcoming surface tension/surface energy incompatibilities between the first coating layer and the substrate by forcing the first coating layer to be more uniformly applied by the liquid squeegee effect of the rolling bank of coating material and second coating layer applied by the second coating die that thins and widens the first coating layer on the substrate.

EXAMPLES

Objects and advantages of this disclosure are further illustrated by the following non-limiting examples. The particular materials and amounts thereof recited in these examples as well as other conditions and details, should not be construed to unduly limit this disclosure. Unless otherwise noted, all parts, percentages, ratios, etc. in the Examples and the rest of the specification are by weight.

Example 1

An experimental setup was prepared generally as depicted in FIG. 1. The first coating die slot width was 2 inches (5.1 cm) and the first slot height was 0.002 inch (0.05 mm). The second coating die slot width was 4 inches (10.2 cm) and the second slot height was 0.030 inch (0.76 mm). The back-up roll was 10 inches (25.4 cm) in diameter. The substrate threaded around the back-up roll was a flat liner commercially available as "3M SCOTCHCAL" High Performance Film, from 3M Company of St. Paul, Minn. The film had a thickness of approximately 0.1 mm. This substrate was conveyed around the back-up roll adjacent to the first and second dies at a line speed of 25 feet/min (7.62 m/min).

The material for the wetting layer (first coating layer) that was dispensed from the first coating die was a low viscosity, low percent solids adhesive formulation derived from iso-octyl acrylate, acrylamide, and Silicone Macromer-1 (SM-1) in a 91:4:5 ratio by weight and prepared as described in Examples 2-4 of U.S. Pat. No. 4,693,935. SM-1 had a molecular weight of about 11,000 g/mol and was prepared as described for Monomer "C 3b" of U.S. Pat. No. 4,693,935. The wetting material was diluted to 1.6 wt. % solids in methyl-ethyl ketone. A small amount of UV fluorescing dye commercially available as Uvitex from BASF Co. of Ludwigshafen, Del. was added so that the wet thickness of the first coating layer could be optically assessed.

The material for the transport layer (second coating layer) that was dispensed from second coating die was a higher viscosity formulation comprising a copolymer of iso-octyl acrylate and acrylic acid in a 90/10 ratio by weight and prepared as described in Example 26 of U.S. Pat. No. 4,693,935. This material was diluted to 14 wt. % in methyl-ethyl ketone.

The first and second coating fluids were gravity fed from holding vessels. The first coating fluid was gravity fed to a syringe pump commercially available as "MODEL 22" from Harvard Apparatus of Holliston, Mass. The second coating fluid was gravity fed to a gear pump with a metering capacity of 11.2 cubic centimeters per revolution and commercially available from Zenith Pumps of Monroe, N.C. Downstream of the gear pump, the second coating fluid was metered at a rate of 185 g/m by a flow meter commercially available as "MICROMOTION CMF25" from Emerson Electric of Ferguson, Mo.

The spacing between the first coating die slot and the back-up roll was set to form a consistent coating bead, and to deliver a first coating layer on the substrate at a nominal 2 inches (5.1 cm) in width, which corresponds to first coating die slot width. The gap 25 between the second coating die slot and the back up roll was set to 0.025 inch (0.64 mm), and a 4 inch wide (10.2 cm) second coating layer was deposited on top of the first coating layer. Under these conditions, the width of the first coating layer did not spread from its nominal 2 inches (5.1 cm) in width. Knowing the delivery rate, the liquid density, and the first coating width, the wet layer thickness was projected to be about 11.7 μm.

The substrate with its two coating layers was then dried by conveying it through a curing/drying station having five temperature zones of 49, 66, 66, 74, and 82° C. over a length of about 12.2 m. The cured/dried coatings were then passed through a laminating station in which a 2 mil (51 μm) PET backing material was laminated to the dried second coating layer. After drying, the thickness of the first coating layer was determined to be 0.19 μm based on the solution properties.

Example 2

An experiment was performed generally as described in Example 1, except that the second coating die was brought closer to the substrate, and the gap (25) was reduced to 0.015 inch (0.38 mm). Under these conditions, it was observed that the second coating fluid (liquid squeegee), caused the first coating fluid to spread and thin on the substrate increasing the width of the first coating layer from 2 inch (5.1 cm) nominal to 3.13 inches (80 mm). Knowing the delivery rate, the liquid density, and the first coating width, the wet layer thickness was projected to be about 7.5 μm in thickness so that after drying the first coating layer thickness would be 0.12 μm.

Example 3

An experiment was performed generally as described in Example 1, except that the second coating die was brought closer to the substrate, and the gap (25) was reduced to 0.010 inch (0.25 mm). It was observed that the second coating fluid caused the first coating layer to further spread and thin on the substrate, and the width that of the first coating layer increased from the nominal 2 inches (5.1 cm) to 4 inches (102 mm) resulting in a wet layer thickness of the first coating layer of about 5.9 μm and a corresponding dry thickness of 0.09 μm.

Figure 2:
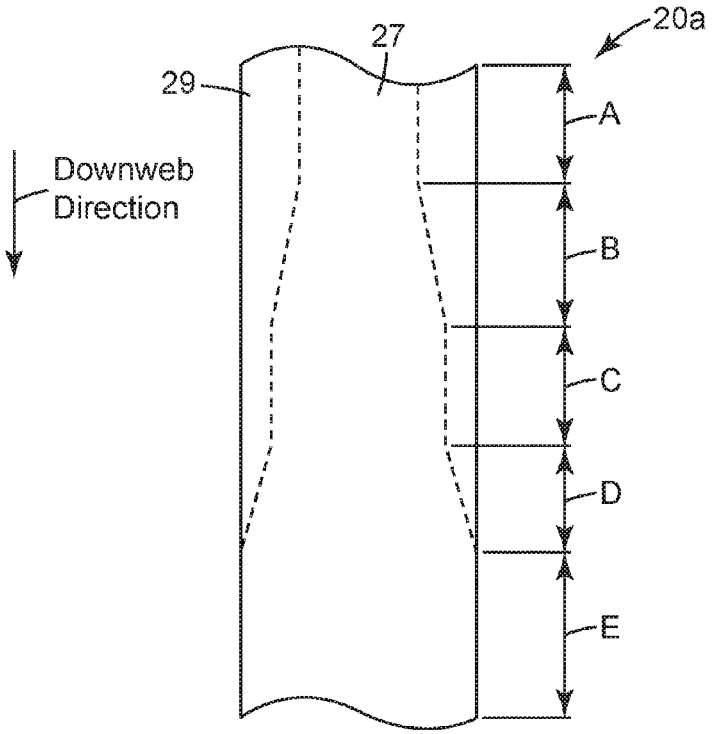
FIG. 2 is a plan view of a section of coated web depicting Examples 1, 2, and 3.

Referring now to FIG. 2, a plan view of the coated substrate 20*a* on which Examples 1, 2, and 3 have been depicted is illustrated. Zone "A" is the coated substrate for Example 1. The first coating layer (the wetting layer) 27 is being visualized through the second coating layer (transport layer) 29 that overlies it. With the gap 25 of the second coating die set to the conditions of Example 1, the first coating layer 27 is still at the nominal 2 inches (5.1 cm) width at which it was laid down. In Zone "B" the operator was moving the second coating die 14 closer to the back-up roll 22, and the first coating layer 27 is being spread wider by the second coating fluid as it passes through the gap 25. In Zone "C" the second coating die 14 is in a fixed position according to the conditions of Example 2, and the first coating layer 27 was spread to the width of 3.13 inches (80 mm). In Zone "D" the operator was again moving the second coating die 14 closer to the back-up roll 22, and the first coating layer 27 is being spread wider by the second coating fluid as it passes through gap 25. In Zone "E" the second coating die 14 is in a fixed position according to the conditions of Example 3, and the first coating layer 27 was spread fully to the width of the second coating die slot of 4 inches (102 mm) as recited in that Example. While the drawing depicts both coatings extending to the very edge of the substrate, this is not necessary and often the substrate will be slightly wider than the second coating slot width.

After Example 3 was performed, the gap 25 was increased back to the condition of Example 1 and it was observed that the width of the first coating layer was reduced back to the nominal 2 inches (5.1 cm) in width. Little hysteresis was observed as the second coating die was moved in and out, plotting gap distance vs. width of the first coating layer.

Referring now to FIG. 4, a SEM micrograph of a coated substrate made according to the method of the present invention is illustrated. In this case, the substrate was a structured release liner, and the micrograph has been taken after the structured release liner has been peeled away from the first coating layer 27. FIG. 4 illustrates that the first coating layer can be substantially conformal and the average thickness of the first coating layer is smaller than the groove or channel formed in the first coating layer by the structured release liner having a corresponding rib on its first major surface facing the first coating die. This result is surprising and shows that the method of the present invention, using the second coating layer as a "liquid squeegee" by reducing the gap (25), causes the first coating layer to uniformly coat a structured release liner having variations in height greater than the first coating layer's wet film thickness. In other words, the first coating layer has a substantially uniform thickness and follows the contours of the structured release liner onto which it is first applied. In various embodiments of the invention, the first coating layer can have a dry thickness less than a height of a channel formed in the first coating layer by a structured liner, or less than 90%, 80%, 70%, 60%, or 50% of the height of a channel while still being substantially continuous and following the contours formed into the first coating layer by the structured release liner.

As shown in the Examples, the dry first coating width can be significantly greater than the first coating die slot width when using the transport coating (second coating layer) as a liquid squeegee. In various embodiments of the invention, the dry first coating width can be at least 50%, 100%, 150%, or 200% greater than the first slot width. As shown above, the final dry first coating width was 200% greater than the first slot width in Example 3.

Example 4

An experiment was performed as generally described in Example 1, except that the second die comprised a dual slot coating die with the first slot of the coating die used to apply the first coating fluid onto the substrate and the second slot used to apply the second coating fluid over the first coating layer. Both slots had a nominal slot width of 4 inches (10.16 cm), and the first slot height was 0.004 inch (0.10 mm). The first coating fluid "wetting layer" was formulated at 5% solids rather than 1.6% solids used in Example 1 and contained a small amount of silica. The viscosity of the first coating fluid was approximately 7 cps and was delivered to form a wet layer thickness for the first coating layer of approximately 2 mils. Under these conditions, it was observed that the second coating fluid mixed with the first coating fluid (wetting layer), resulting in adhesive blobs and failed to form uniform discrete layers. This example shows material selection to control interfacial tension between the two coating layers is important in obtaining a coating example that exhibits discrete layers as shown in FIG. 4.

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of coating a substrate comprising:

providing a first coating die having a first slot width;

providing a second coating die having a second slot width;

applying a first coating fluid from the first coating die onto a substrate forming a first coating layer;

applying a viscoelastic second coating fluid from the second coating die over the first coating layer on the substrate forming a second coating layer; and varying a gap between the second coating die and the substrate to increase a width and reduce a thickness of the first coating layer on the substrate;

wherein the second slot width is greater than the first slot width, and wherein the gap is reduced until the width of the first coating layer is increased to substantially equal a width of the second coating layer.

2. A method according to claim 1 wherein the first and the second coating dies are combined in a single die body.

3. A method according to claim 2 wherein the substrate comprises a structured liner having at least one rib on a first major surface facing the first coating die.

4. A method according to claim 2 wherein the first coating layer comprises a channel and an average thickness of the first coating layer is less than a height of the channel.

5. A method according to claim 2 wherein the first coating fluid has a Newtonian flow characteristic.

6. The method of claim 2 wherein a third coating layer is applied over the second coating layer.

7. The method of claim 2 wherein the first coating layer comprises a dry first coating width, and the dry first coating width is at least 50% greater than the first slot width.

8. The method of claim 7 wherein the dry first coating width is at least 150% greater than the first slot width.

9. The method of claim 2 wherein the viscoelastic second coating fluid has a higher viscosity than the first coating fluid at the same shear rate.

10. The method of claim 2 wherein the viscoelastic second coating fluid comprises a shear thinning fluid having a lower viscosity at a higher shear rate.

11. A method according to claim 1 wherein the first and the second coating dies are each in a distinct die body dispensing onto the substrate at separated positions along the substrate's length.

12. A method according to claim 11 wherein the substrate comprises a structured liner having at least one rib on a first major surface facing the first coating die.

13. A method according to claim 11 wherein the first coating layer comprises a channel and an average thickness of the first coating layer is less than a height of the channel.

14. The method of claim 11 wherein a third coating layer is applied over the second coating layer.

15. The method of claim 11 wherein the first coating layer comprises a dry first coating width, and the dry first coating width is at least 50% greater than the first slot width.

16. The method of claim 15 wherein the dry first coating width is at least 150% greater than the first slot width.

17. The method of claim 11 wherein the viscoelastic second coating fluid has a higher viscosity than the first coating fluid at the same shear rate.

18. The method of claim 11 wherein the viscoelastic second coating fluid comprises a shear thinning fluid having a lower viscosity at a higher shear rate.

* * * * *